US011218788B2

(12) United States Patent
Champagne

(10) Patent No.: US 11,218,788 B2
(45) Date of Patent: Jan. 4, 2022

(54) PORTABLE CAR STEREO BOOMBOX IN A PIPE WITH A NOVEL MOBILE DEVICE HOLDING BAY, NOVEL CARRY HANDLE ANTENNA AND A NOVEL NIGHTLIGHT

(71) Applicant: Luc Daniel Champagne, Orleans (CA)

(72) Inventor: Luc Daniel Champagne, Orleans (CA)

( * ) Notice: Subject to any disclaimer, the term of this patent is extended or adjusted under 35 U.S.C. 154(b) by 0 days.

(21) Appl. No.: 16/890,358

(22) Filed: Jun. 2, 2020

(65) Prior Publication Data

US 2021/0377638 A1 Dec. 2, 2021

(51) Int. Cl.
*H04R 1/02* (2006.01)
*H04R 3/00* (2006.01)

(52) U.S. Cl.
CPC ..... *H04R 1/026* (2013.01); *H04R 1/025* (2013.01); *H04R 3/00* (2013.01); *H04R 2420/09* (2013.01); *H04R 2499/13* (2013.01)

(58) Field of Classification Search
CPC ..... H04R 2499/13; H04R 1/025; H04R 3/00; H04R 1/026; H04R 2499/11; H04R 2420/09
USPC ..... 381/86
See application file for complete search history.

(56) References Cited

U.S. PATENT DOCUMENTS 9,866,936 B2 * 1/2018 Patrone ..... H04R 3/00

* cited by examiner

*Primary Examiner* — Paul Kim

(57) ABSTRACT

A portable multimedia device includes: An enclosure; a wireless communication element enclosed within the enclosure, the wireless communication element able to receive audio data from a mobile device; a pair of speakers enclosed within the enclosure that are able to generate an audio output based on the audio data received from the mobile device or directly from the head units internal radio and its external antenna; and a set of external connection ports. Also within the enclosure; a battery pack charger board, able to charge the battery pack converted from household power, which sends the electricity necessary to power the head unit and speakers. A light on the charger's circuit board within the enclosure is able to light up as a nightlight. Exterior and configured to be secured to the enclosure: Mobile device holding bays that are able to carry or hold mobile devices onto the boombox system; a carry handle antenna that is able to improve reception and able to carry the boombox and a mobile device simultaneously; a carry strap able to carry the boombox and a mobile device simultaneously; a switch that is able to provide electricity to the stereo, its memory and to the speakers from the battery pack; and speakers configured to be secured to the pipe which are covered by speaker covers configured to slide onto the pipe; and speaker screens that are configured to slide into the covers.

1 Claim, 26 Drawing Sheets

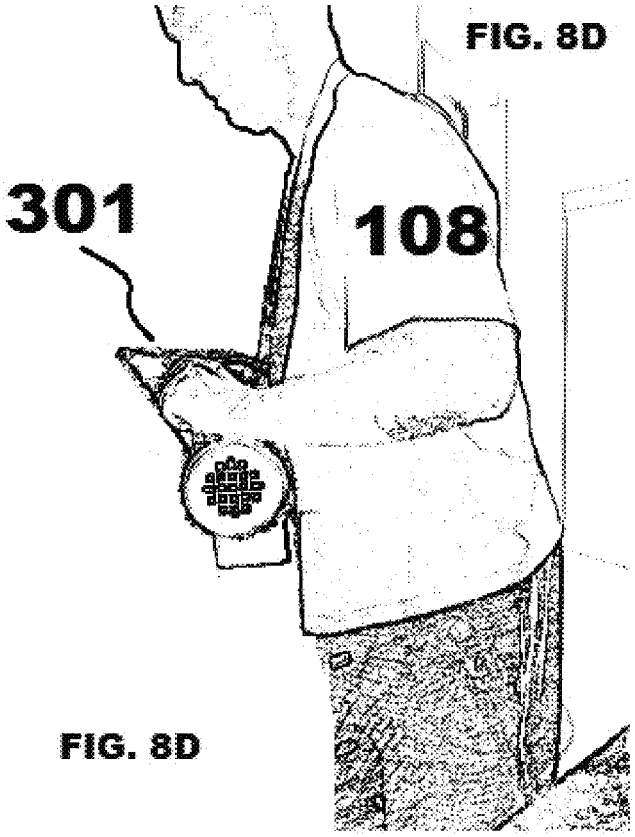
FIG. 8D
FIG. 8D
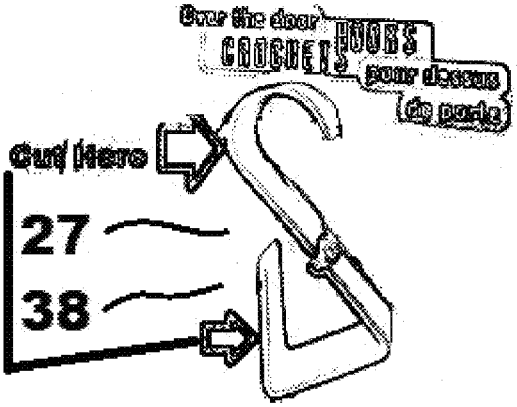
FIG. 9

This flat area marks where the spruce wood meets with the bottom of the head unit.
It is currently facing the proper direction to enter the upright device with the box base at the bottom

PORTABLE CAR STEREO BOOMBOX IN A PIPE WITH A NOVEL MOBILE DEVICE HOLDING BAY, NOVEL CARRY HANDLE ANTENNA AND A NOVEL NIGHTLIGHT

FIELD OF THE INVENTION

The present invention relates to A NOVEL PORTABLE BOOMBOX CAR STEREO DESIGN WITH A NOVEL MOBILE DEVICE HOLDING BAY, NOVEL CARRY HANDLE ANTENNA GRIP AND A NOVEL MINIATURE LIGHT THAT CAN LIGHT UP AND ACT AS A NIGHT-LIGHT.

BACKGROUND

In the world of boomboxes there are hundreds of different types of systems. Unfortunately, this field is divided. Various kinds of electronic products are constantly developed and introduced into the market to satisfy consumer demands for novel and improved products. Lower cost systems are not providing the quality deserved by music lovers and garners and are separated in parts. The separation of a boombox and a mobile device stand causes an extra bulkiness, expense and effort when setting up the stand. Unfortunately antennas are not strong enough or properly shaped to use as a carry handle and there aren't any boomboxes with built in night-lights as well. The initial intention of this invention was not intended to be a home boombox. It was initially intended to be a boombox for an e-bike I innovated. It ended up being a bit too large for that project and not weatherproof, thus the conversion began.

There are no prior arts of a mobile device holding bay on a boombox, where you can hold or carry a mobile device of various types along with it, hands-free, using the carry strap on the operators neck.

Furthermore, there are no prior arts which combine a carry handle with an antenna to allow the operator to increase its radio reception while carrying the boombox around.

Furthermore there are no prior arts which use a 3.5 mm auxiliary male to male cable where one of the male adapters is placed and secured into the ANT female slot behind a car stereo's head unit.

Furthermore there are no boombox prior arts with battery hot and cold protections Furthermore there are no boomboxes along with a light that can light up like a nightlight.

There are no prior arts with combined with slideable speaker covers comprised of pipe fittings.

An example of a portable speaker system can be seen in U.S. Pat. No. 9,307,307 B2 filed by Patent Genius on behalf of the inventors, which describes a portable speaker system, a wireless communication element able to receive audio data from a mobile device; a pair of speakers able to generate an audio output based on the audio data received from the mobile device and a set of connection ports. More closely related prior arts include;

BumpBox flare6 Bluetooth Boombox;

and the Monster Nomad indoor/outdoor Wireless BT speaker. Results are according to search report TPS55842 by Thoughts to Paper
20251 Century Blvd Ste 140
Germantown, Md. 20874

It can get tiresome to keep holding a tablet and a boombox at the same time for long periods. There are no boomboxes which offer you to carry with it, a mobile device at the same time with your neck via a comfortable strap or 1 hand via a carry handle. There are no boomboxes that appear as a mini-theater system because they don't have any holding bays so the mobile device is unable to appear on top of the boombox and be secured onto it. Because there are no boomboxes with mobile device holding bays attached, all other prior art requires you to either keep holding the mobile device or rest it on a surface which may not be as convenient to get a good viewing angle of the mobile device in a vertical position and furthermore may not be safe to maintain its vertical position from falling over and potentially damaging the mobile device.

While there are carry straps in the art, they are limited in comfort particularly when carrying around the neck, based on lack of cushion and poor smoothness of material used in the arts.

When a person would also like to use their boombox as a nightlight, there are no prior arts which provide this in a boombox, requiring people to use a separate nightlight when needed. This saves materials as one less nightlight is needed to be purchased.

While there are antennas in the art, they are relatively lengthy for what is required to get good reception on many FM channels and some AM and furthermore not sturdy enough to be used to also carry the entire boombox with it, as a combined carry handle.

The need for a separate antenna is eliminated when made as part of the handle. It is strong enough to carry mobile devices of various types as well.

People who wish to free up their hands for other purposes other than holding a mobile device will appreciate a boombox which can do so for them.

BRIEF SUMMARY OF THE INVENTION

The present invention consists of a pipe with mobile device holding bays, a car stereo, a pair of speakers, a switch, a box base, speaker covers, a wall cable, a carry strap and a carry handle antenna grip all secured to its outer surface. Partly within the pipe is a battery pack and its charger's circuit board. At the bottom of the boombox is a rectangle box base which is attached to the pipe. A hole is in the pipe, center of the boombox, where the square base meets up with it so that the charger's circuit board which has two visible L.E.D lights is partly within this transparent rectangle box base. In other embodiments, the carry handle antenna and mobile device holding bays may be of different sizes, thicknesses and materials. As well, in other embodiments, the battery pack and charger circuit board may be entirely encased in the pipe with the vent hole as part of the battery pack's enclosure lid or in any other area which allows for air flow from the right hand speaker. The left speaker also has its own vent. The front area of this invention is at the carry handle antenna's location. There is a switch so you can save your battery or the stereo's memory. There is a fast charger with protections to charge a compact battery pack which holds into an internal battery bay of the pipe. You can easily remove the partly exposed battery pack by pulling it out of the internal bay. The battery plug is exterior to the boombox however, in a preferred embodiment, it may be enclosed entirely within the pipe. (Functional prototype available)

BRIEF DESCRIPTION OF THE DRAWINGS

Some embodiments of the present invention are illustrated as an example and are not limited by the figures of the accompanying drawings, in which like references may indicate similar elements and in which:

FIG. 8D, illustrates; a further left side view of the multimedia device being carried along with a mobile tablet resting in its mobile device holding bays.

FIG. 9, shows; an example of a side view of; an over the door hook 27, 38 with a rubber loop half way up which can be made of different materials and shapes in alternative embodiments.

DETAILED DESCRIPTION OF THE INVENTION

The terminology used herein is for the purpose of describing particular
embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises of, consists of, made from" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific
terms) used herein have the same meaning as commonly understood by one having
ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of
techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

New mobile device holding bays are
discussed herein. In the following description, for purposes of explanation, numerous specific details are set forth in order to provide a thorough understanding of the present invention.

The present disclosure is to be considered as an exemplification of the
invention, and is not intended to limit the invention to the specific inventions embodiments illustrated by the figures above or descriptions below.

Figure 1:
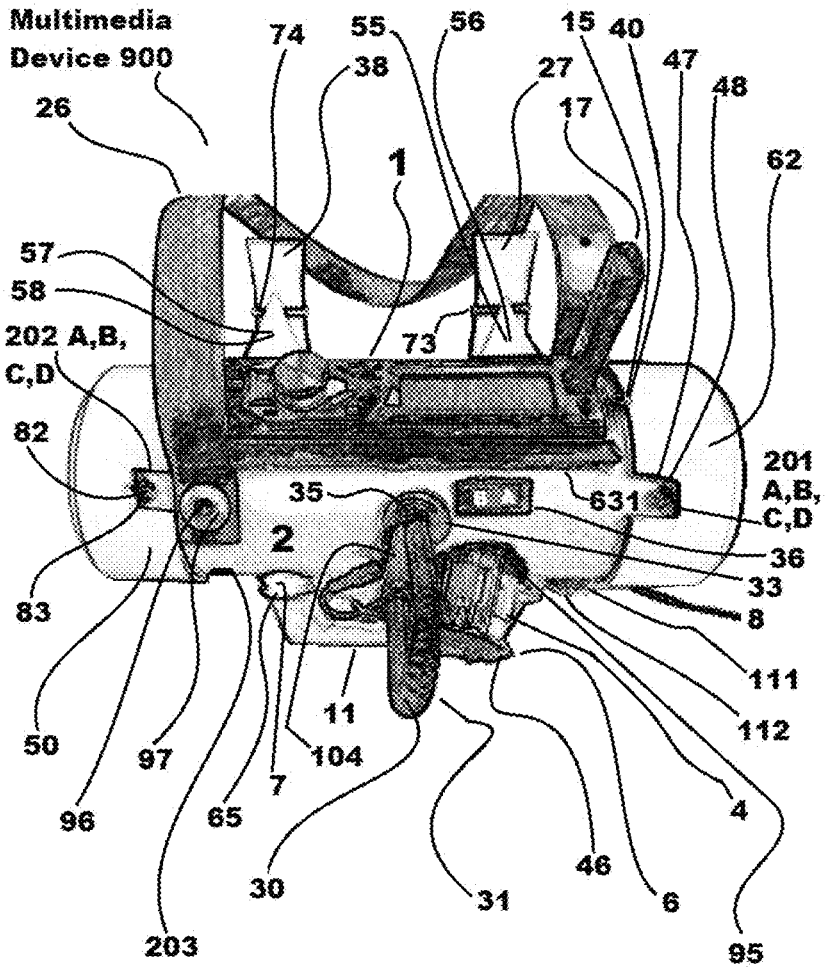
FIG. 1, illustrates; a car stereo receiver panel 1 and an antenna carry handle 31 which can be made of different materials and shapes in alternative embodiments.

The present invention will now be described by referencing the appended
figures. FIG. 1 depicts a top center, front full view of the present invention 900. The four inch diameter PVC pipe 2 is first cut to 9 and ⅜ inches. In preferred embodiments, the pipe 2 is longer by ½ inch making it a total of 9⅞ inches. This preferred embodiment results in no longer requiring a carving in the center of the spruce wood 1 mm larger than the circumference of the speaker magnet 504 of FIG. 17. The center carving 504 is ¼ inch out of the ½ inch total thickness of the spruce wood 503. In other further embodiments the pipe may be cut at any length. A plurality of holes is necessary in the pipe for all multimedia device 900 of FIG. 20; components as displayed further in FIG. 1 and within the other drawings. One extra
hole is thus necessary in the present invention compared to a preferred embodiment; whereas there is no longer a need for a rectangular hole in the bottom of the pipe 2 for charger's circuitry's protrusion 63 of FIG. 18 into the box base 11 of FIG. 18. The capability of the m18 (for 18 volt battery charging) circuitry to be removed, the board then is able to be reduced in size by around 50% and while only one of the dimensions is needed to be reduced for achieving entire encasement into the pipe 2, there is more than sufficient area in the pipe after the circuit boards 63 reduction in parts and size to only accommodate m12 XC battery charging. Example of an alternative embodiment: LaiPuDuo M12 lithium Ion charger on Amazon. There is flexibility in sizes required for the charger 63 to fit in the pipe 2 so the exact 50% in circuit board reduction is not necessary. This preferred embodiment would have any of the given dimensions (length or width) to be 3 inches diameter while the other dimension may remain the same of 5 inches however no higher than this. In another embodiment, with the circuit board 63 entirely encased in the pipe 2, the battery 4 may be stored and used within the box base 11 with a re-routing of the necessary five DC wires 611A-E of FIG. 13 extended and a battery terminal plug 6 positioned touching the box base's 11 front wall at the bottom right corner, facing in a vertical position with two possible extra m12 XC battery packs 4 stored beside each other within the original box base 11, or a box based reduced in height FIG. 16A,B. This box base may either have a small-hinged, large door, or large clip-on door located at the bottom of the box base 11 for battery 4 access and manual plug 6 attachment and removal; from within the box base 11. In a preferred embodiment, the battery access door can be of any size larger than the m12 XC battery pack 4 and may be composed of plastic or another material. Further, in another embodiment, two circuit board chips (yellow and green) currently obstructing the internal battery bay from being secured to the pipe's 2 interior may be repositioned anywhere from the center of the circuit board 63 progressing leftward so that mounting of the internal battery bay 950 of FIG. 23A,B to the pipe's 2 interior becomes possible. This will allow the battery to fully enter the pipe and be entirely enclosed.

Figure 4:
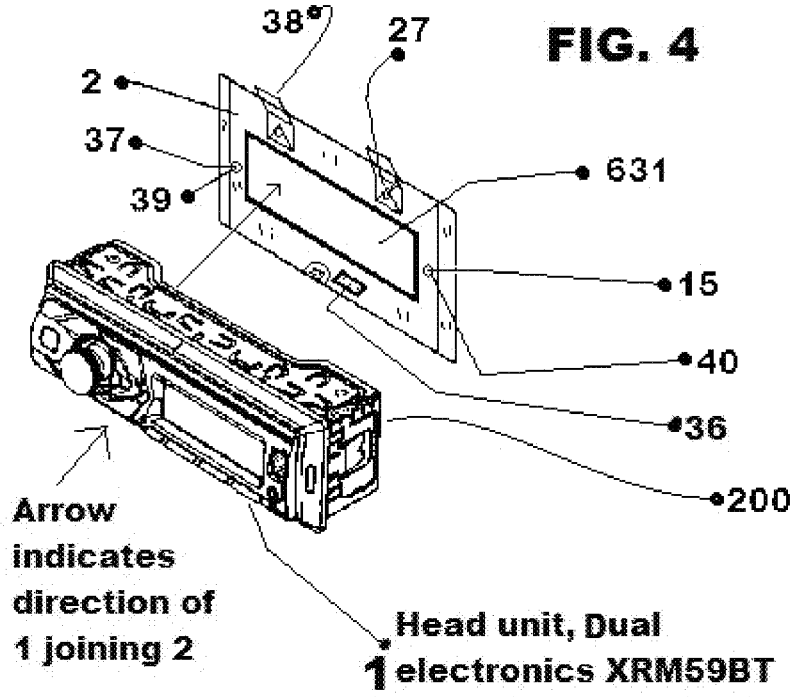
FIG. 4 shows the direction of entry for the head unit into the pipe enclosure.

631 of FIG. 1 and FIG. 4 displays a rectangular hole 631 of FIG. 4 cut 7¼ inch long×2⅛ inch wide to accommodate the XRM59BT car stereo's head unit 1. This hole 631 is made at what will be the near top of the boombox. In another embodiment, the head unit 1 can be in the top dead center of the multimedia device 900. Currently, the head unit's 1 front panel is angled 5 degrees towards the front of the multimedia device 900. The rear border of the head unit's front panel 1 is pressed and secured onto the pipe 2 by the two ¾ inch self drilling screws 15,37 located at
the center of the two sides of the head unit's 1 front panel.

Figure 18:
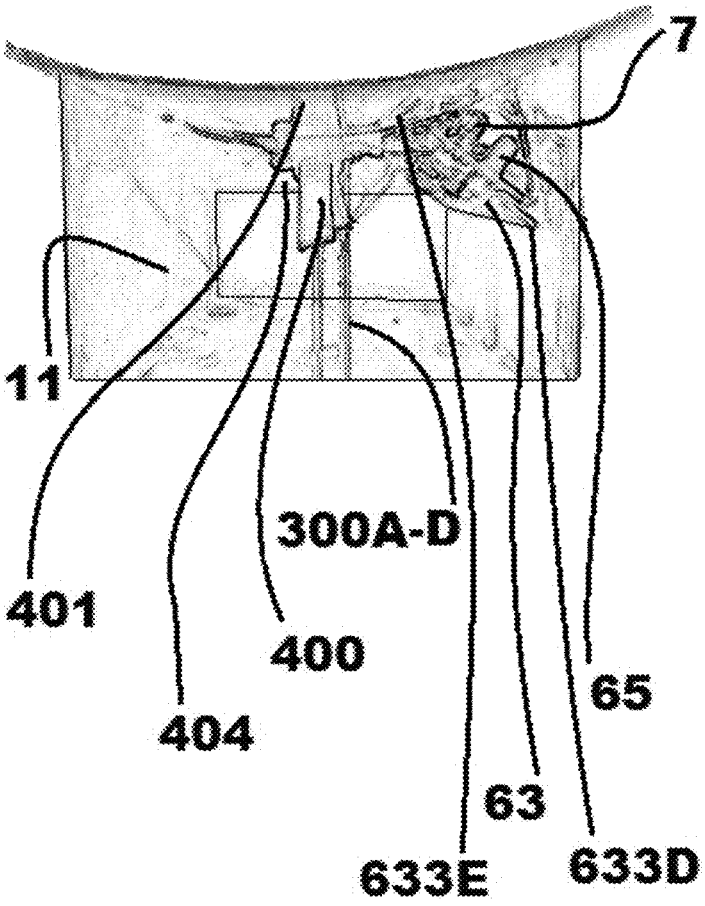
FIG. 18, illustrates; a substantially left lower view of the multimedia device highlighting the circuit boards L.E.D lights.

The secondary component enclosure is the box base 11 of FIG. 1 and many other drawings. This paragraph is in regards to all aspects of the bottom area of the multimedia device 900: The box base 11 is transparent and measures 5½ inches long×3¾ inches wide×3 inches deep. Its top is open so that the charger's circuit board 63 can partly enter its top area by 1⅜ inch. the box base 11 has an upper front center, rectangular cutout for wires however this cut out is not necessary with the hole 975
of FIG. 23A nearby above it. In a preferred embodiment FIG. 16B, the height of this box base is reduced to 2 inches in height. If the charger's circuit board 63 of FIG. 18 is reduced to around 50%, the box base 11 is no longer necessary. In order to stabilize the multimedia device, four of ⅛ inch L-bolts are placed in corresponding holes just after where the speaker cover sleeves 50,62 of FIG. 1 end on the pipe 2 and on the exact sides of the pipe, both front and rear, directly below where the carry strap 26 is screwed to the pipe 2. The speaker cover sleeves 50,62 of FIG. 1 push over the pipe as far as possible. These sleeves are prohibited from sliding any further than the beginning of the self drilling screws 39,40 of FIG. 4 directly below their heads. These ¾ inch self drilling screws are initially and primarily used to fasten and secure the head unit's front panel 1 to the pipe 2.

Figure 16A:
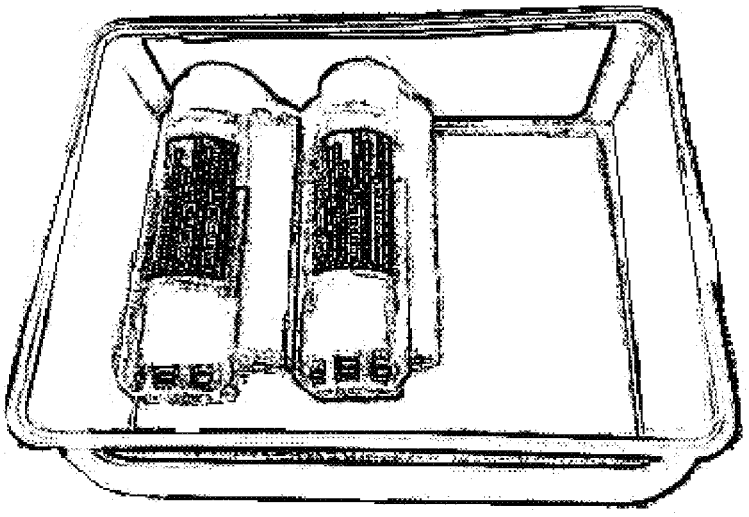
FIG. 16A, displays; an inside view of a shorter box base 11 preferred embodiment. It may be used as an extra battery pack storage compartment if the charger's circuit board is entirely enclosed within the pipe 2. This preferred embodiment may have a clip-on or a hinged lid at the bottom of the box base. Display of box base only.

In a preferred embodiment where the battery charger's circuit board 63 of FIG. 18 is reduced by around 50%, the remaining preferred box base FIG. 16A,B may be used or the original FIG. 1 as solely a battery storage compartment with either a hinged or clip-on lid at the bottom center 2 cm less in diameter than the dimensions stated above; beginning of paragraph. This battery storage compartment will contain the terminal plug 6 to be used on one of the three possible m12 XC batteries 4 (For Milwaukee M48-11-2401). As displayed in FIG. 16A preferred embodiment, likewise in the original embodiment, both box bases 11 are suitable dimensions for up to a total three m12 XC battery packs 4. Each battery pack 4 consists of three lithium ion cells, is 12 volt 3 amp hour, or 36 Watt hour total.

The m12 XC battery pack 4 measures 1⅝ inch long×1⅜ inch wide×3¼ inches high. It enters the pipe 2 about ⅔rds its height and protrudes in a downwards and leftwards diagonal position about ⅓rd its total height.

The hole 95 in which the battery 4 enters, is 3 mm wider than the circumference of the battery 4 in all areas of its circumference that entirely matches its shape.

Directly above the hole 95 is a rocker switch 36 originally used on a 15 amp power bar by Globe. This rocker switch 36 has an A and B indicator in the drawing which indicates; A indicates Off as displayed on the switch. This setting will shut off all power to the head unit 1 which includes its memory as the memory wire is joined with the positive main power wire of the head unit (yellow and red wires). All presets
are reset upon flipping the switch back from position A to position B. Leaving the
switch on position B will preserve all presets however will sacrifice the energy of the battery and will drain it entirely prompting the operator to plug the two prong, 120 v AC wall cable 8 into a 120V AC wall outlet if they wish to use the multimedia device boombox 900.

Plugging the 120V AC wall cable 8 into the wall, activates the battery charger 63 so long that there is the battery 4 connected fully with its battery terminal plug 6.

Figure 5A:
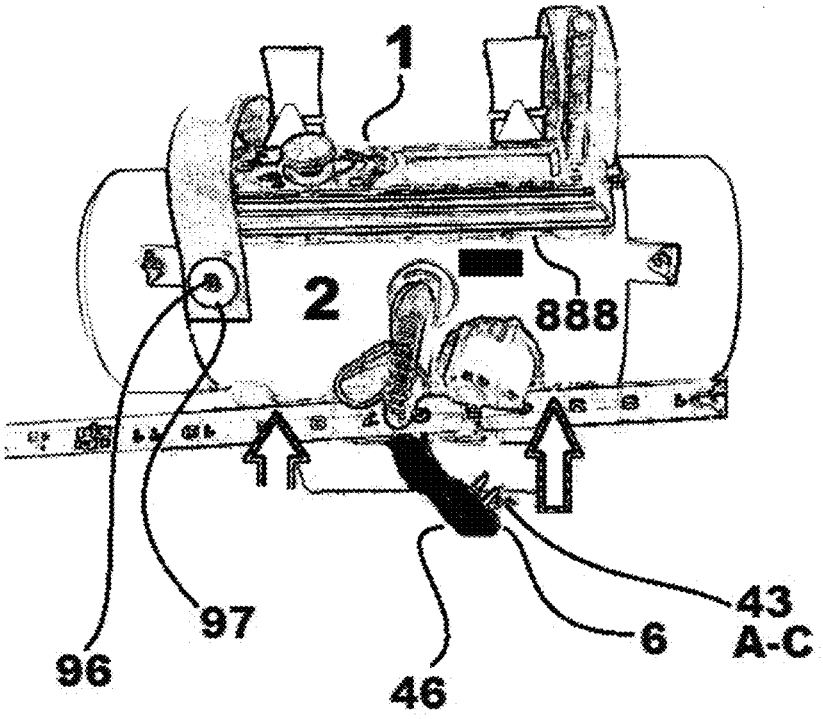
FIG. 5A, illustrates; a front center, full view of the multimedia device 900.

4 of FIG. 1 displays the top part of the battery 4 where the 3 battery sensor terminals are located flat on the battery packs 4 outer surface, however; 43A-C of FIG. 5A displays the three prongs of the battery terminal plug 6 which are essential to be fully slid onto these three flat sensor terminals on the battery pack 4 in order for the battery charger 63 to get a proper reading of the battery's 4 status before engaging in its lithium ion charging process. These three prongs 43A-C are connected to a fraction; three of the five wires of 611A-E of FIG. 2 attached to charger's 63 circuitry. Without the battery charger's terminal plug 6 fully slid over the battery packs three sensor terminals, the charger's L.E.D lights; 7,65 of FIG. 18 will not light up and neither will the charger be activated when the 120V AC wall cable 8 is plugged into the wall. It is also possible these two lights may be flashing, one light then the other, repeatedly.

Figure 24:
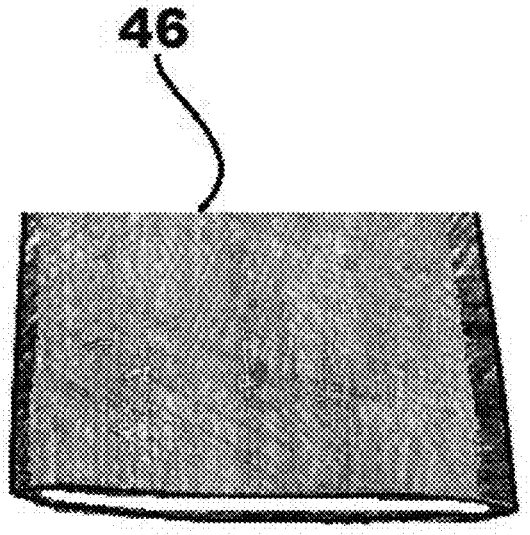
FIG. 24, illustrates; a top view of the heat shrink tube.

The battery's terminal plug 6 and its five of 12V DC wires are then enclosed by a 52 mm diameter heat shrink tube in FIG. 5A. The heat shrink tube FIG. 24 is cut to shape to match the perimeter of the battery terminal plug 6 and sized to 3 inches long. In alternative and preferred embodiments, this heat shrink and process would be eliminated due to a fully covered and stationary battery terminal plug able to be secured inside of the box base 11.

30,31 of FIG. 1 are the primary numbers which make up the carry handle 30 and antenna 31 of the multimedia device 900. The washer 33 is what secures the handle from prying on the PVC plastic pipe 2. The nut 35 is what secures the front washer 33 by sandwiching the pipe between an internal washer 32 and nut 34 of FIG. 23B.

The carry handle's primary part is the ¼ inch diameter×4 inch long U-bolt.

Wrapped around starting from top to bottom, is the radio antenna 31; comprises a 4 foot long, 3.5 mm auxiliary cable. It then travels through the top of the rectangular opening in the box base, just below the ⅜ inch square hole 975 of FIG. 23A to then enter the ANT female socket outlet 200 of FIG. 13 on the rear of the head unit 1. In a preferred embodiment, this hole is no longer necessary as the wires 611A-E of FIG. 2 can remain within the pipe 2 along with their battery terminal plug 6. In another embodiment, this auxiliary cable may enter the hole 975 of FIG. 23A instead. This cable goes directly to the ANT socket outlet of the head unit 1 and does not need to be secured anywhere but at the socket point in which hot glue is applied. In a preferred embodiment, epoxy glue (JB weld) may be used at the head unit's 1 ANT socket outlet 200 and cured prior to use for extra longevity of adhesive between the auxiliary cable 31 and the ANT socket outlet 200; able to last many years longer than the current hot glue. The corresponding original car stereo ANT cable has a head that would be too wide for the internal area and would obstruct the internal battery bay 950 from fitting. A preferred embodiment may also use epoxy glued (JB weld) adhesive for extra long adhering of the internal battery bay to the speaker magnet 950 of FIG. 23A,B or to the pipe 2. Further details of the parts which make up the carry handle antenna will be explained in FIG. 23B In all alternative embodiments, epoxy JB weld may be instead applied, in all areas where hot glue was applied.

Figure 3:
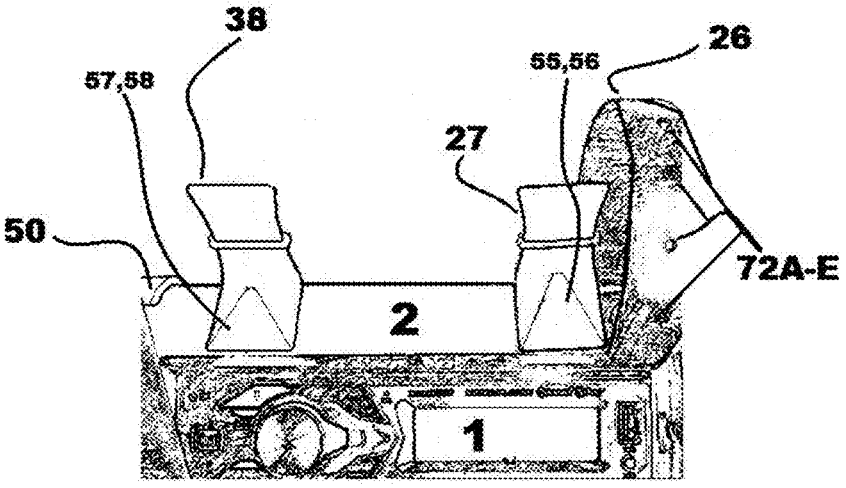
FIG. 3, illustrates; a top center stereo front panel view
Figure 6A:
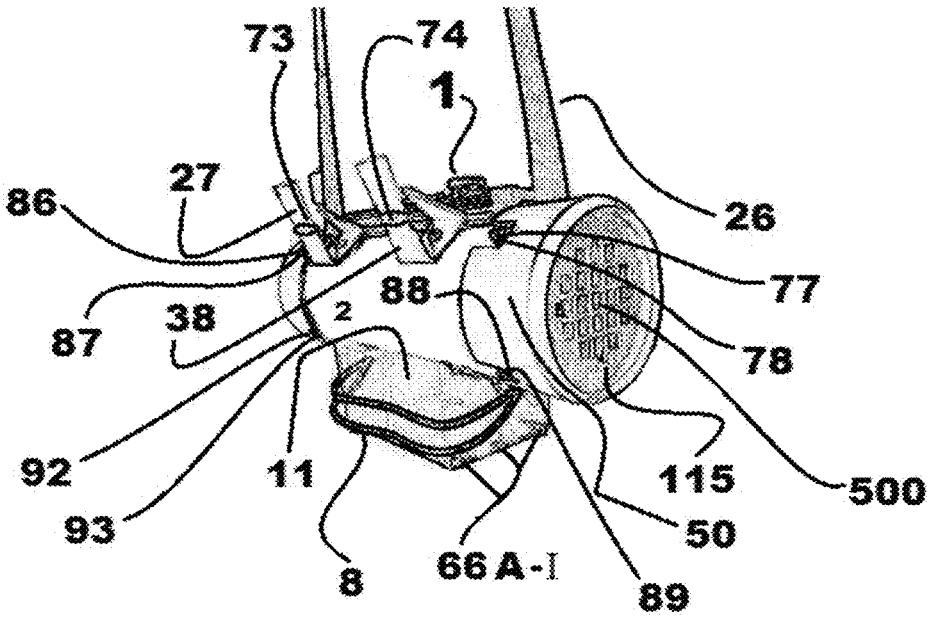
FIG. 6A, illustrates; a left side, angled full view of the multimedia device.

27,38 of FIG. 1 and all other figures point to over the door plastic hooks 27,38 which are cut to shape (triangle on the shorter end) FIG. 9 and FIG. 3 display this best, respectively. The ends of the triangles are flattened out so they are not pointy. The final cut is straight, horizontal and cut just before the hook bend; the longest end of the over the door plastic hook 27,38. The rubber loops 73,74 of FIG. 1 on the plastic over the door hooks 27,38 help secure the mobile device to some extent from sliding side to side when tilting the multimedia device 900. A preferred embodiment may have ridges throughout the rubber loop where the mobile device rests, as grips, and may also comprise of a wider rubber loop 73,74 of 6A attached. FIG. 6A provides a perspective on the width of the rubber loops.

55-58 of FIG. 1 is where the self drilling screws are installed. There is currently 1 per mobile device holding bay 27,38. The ½ inch left screw 57 is when facing the front of the multimedia device 900, the hole for it is 58. The ½ inch right screw 55 is when facing the front of the multimedia device 900, the hole for it is 56. In a preferred embodiment there are ¾ inch self drilling screws side by side in the same location to significantly improve the adhering strength of the mobile device holding bays 27, 38 to the pipe 2. FIG. 6A displays, in a feasible view, these two screws 55,57 of the two mobile device holding bays 27, 38 of FIG. 1 and other drawings.

26 of FIG. 1 displays a neck strap made out of bonded leather. It measures 46 inches long×1⅙ inches wide. In other embodiments the material may be thicker and the carry strap 26 may be longer or shorter. One of the five premade holes 72 A-E of FIG. 1 may be used as a screw hole when shortening the carry strap 26.

96,97 of FIG. 1, displays the front side ½ inch self drilling screw 96 and a ⅞ inch washer 97 for the carry strap 26 made of bonded leather. The other side 998, 999 is identical and is displayed in FIG. 6C. The screw is 998, and the washer is 999 for the rear right carry strap 26 attachment to the pipe 2.

17 of FIG. 1 displays an EAGET 16 GB flash drive connected into the USB socket outlet of the head unit's front panel 1.

82,83 of FIG. 1 shows the left side's, top front, ½ inch self drilling screw 82 and its hole 83. At the right side's, top front, is another ½ inch self drilling screw 47 and its hole 48.

At the left side of the multimedia device 900 is a speaker cover 50 made from a modified Canplas 4 inch DWM PVC Sewer Adapter Sleeve. The sleeve is modified at its flat end (the other end is pointed), four of ¾ inch×¾ inch square contours 202 A-D are cut out of each sleeve (quantity 2).

Figure 2:
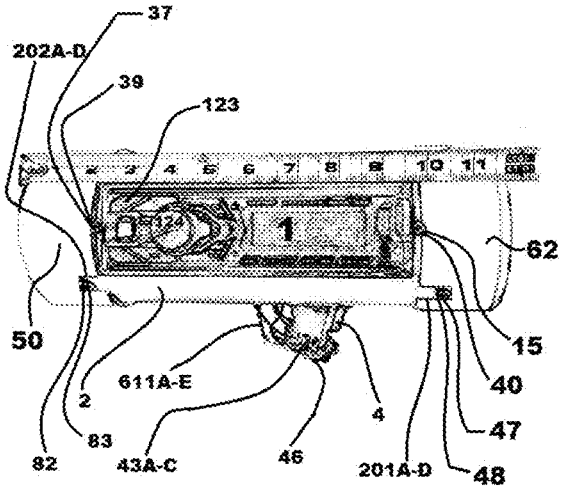
FIG. 2, illustrates; a top center full view of the multimedia device 900 with mobile device holding bays 27, 38, antenna carry handle 30, 31 and carry strap 26, not yet attached.

At the right side of the multimedia device 900 is a speaker cover 62 made from a modified Canplas 4" DWM PVC Sewer Adapter Sleeve. The sleeve is modified at its flat end (the other end is pointed), four of ¾ inch×¾ inch square contours 201 A-D are cut out. These contours 201 A-D, 202 A-D are necessary so that the sleeves 50,62 can successfully slide over the pipe 2 and reach the screws 15,37 at the center sides of the head unit's 1 front panel. FIG. 2 and FIG. 4 shows both of these screws 15,37. These screws 15,37 are meant to fasten the head unit's 1 front panel in the center of its two sides.

There are four screws 82, 897 (front), 77,88 (rear), which secures and fastens the left speaker 500 to the pipe 2. These locations are displayed within various figures.

There are four screws 47, 891 (front), 86,92 (rear), which secures and fastens the right speaker 19 to the pipe 2. These locations are displayed within various figures.

In a preferred embodiment all screws; 47, 82, 891, 897 (front), 77, 86, 88, 92 (rear) for both speakers 500, 19 may be covered by wooden or plastic screw covers or covers of another material.

Figure 20:
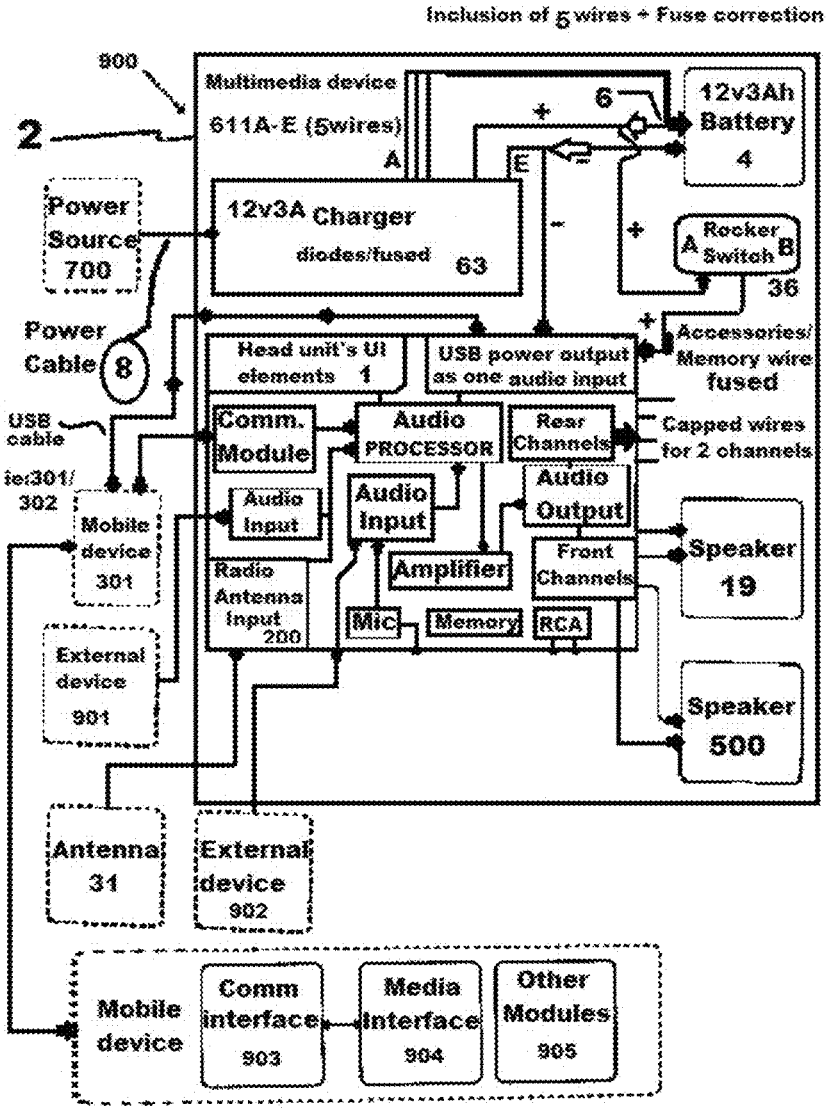
FIG. 20, illustrates; a full diagram for wiring and connectivity of the multimedia device.

36A,B of FIG. 1 displays a rocker switch that is closed when pushing the switch to the B position. When pushed to the 36 A position, the switch is now open and no electricity is sent to the head unit 1 and its internal memory. The switch has the purpose of prohibiting the head unit's memory from constantly draining the battery or to keep the memory presets if preferred. The positive red wire goes from the battery terminal plug 6 to the input of the switch 36. FIG. 20 displays this wiring in a diagram. Then both ends of the head unit's power wire and accessories wire (red and yellow big separate wires) are joined and soldered together at the output terminal of the switch 36. Once switch 36 is pressed to the B position, electricity is sent from the battery 4 and the charger 63.

Measurements for the switch 36 are 1¼ long×½ wide×1 inch deep. In a preferred embodiment the switch 36 is rated no higher than five amps which would reduce its size in depth by ⅓rd. The rectangular hole for the switch 36 is 1 mm in diameter less than the diameter of the switch 36. The bottom side of the switch 36 begins ⅝ of an inch above the top of the hole 95 and is also centered above the hole 95. The top side of the switch 36 is ¼ inch below the bottom side of the head unit 1.

The hole 95 starts at the top end of the box base 11. The right side of the hole 95 begins 7/16 of an inch from the end of the box base's 11 top right side.

Protruding out of the pipe 2 and into the top section of the box base 11 by
1⅜ inch; is the battery charger's circuit board 63 at a thirty five degree angle
from a horizontally leveled surface or the bottom surface of the box base 11.

Soldered in the far left bottom corner of the protruding circuit board 63 into 11 are two L.E.D's. The top L.E.D 7 comprises a green spectrum of light and is the indicator of a fully charged battery 4 when it is solid green. There are protections provided by this Energup charger's circuitry 63; A: No charge to a defective battery 4, Auto Cut off when short circuit. B: Stops when charger faulty detected. C: Stops charging when charging over (no float charge) and stops charging when overheat and battery cold protection. The bottom red L.E.D 65 indicates a charging battery when it is solid red. FIG. 18 shows these L.E.D's more closely. In a preferred embodiment where the charger 63 is entirely enclosed in the pipe 2, there must be a small square transparent plastic window that may be press fit into the pipe 2 directly beside where the L.E.D's 7,65 are on the charger's circuit board 63. This configuration still ensures that the green L.E.D is able to light up a room like a nightlight.

8 of FIG. 1 is the 120V AC wall cable 8 and a two prong plug at the far end to connect into a 120V AC wall outlet socket. At the other end of the cable is spliced and soldered to the 120V AC input solder points of the charger 63.

The remainder of FIG (Figures) will be kept brief by fully describing only the parts which have yet to be described; in order to avoid unnecessary repetition. The multimedia device's 900 is 10 inches long with only the speakers 500,19 attached
and not the speaker covers 50,62. The multimedia device 900 with both sleeves fully slid on the pipe 2 is a total of 11 13/16 inches in length.

FIG. 2 displays a top center view of the multimedia device 900.

1: Head unit (Dual XRM59BT)
2: 4 inch PVC pipe
4: 12V DC M12 XC battery pack for Milwaukee M48-11-2401
15: ¾ inch self drilling screw
37: ¾ inch self drilling screw
39: Hole for screw
40: Hole for screw
43A-C: Three metal pad terminals as part of the battery terminal plug 63 and is intended as a battery sensor.
46: 52 mm heat shrink rubber tubing
47: ½ self drilling screw
48: Hole for screw
50: Canplas 4 inch DWM PVC Sewer Adapter Sleeve left side
62: Canplas 4 inch DWM PVC Sewer Adapter Sleeve right side
82: ½ self drilling screw
83: Hole for screw
123: Main power button quick press, however, when switch 36 is set to B, any button on the head units 1 front panel will turn it on. When Switch is set to A or OFF, no button on the head unit will activate the head unit.
124: Volume and press to toggle EQ button.
201A-D: Four of Square ¾ inch×¾ inch contours cut into the right speaker cover flat end.
202A-D: Four of Square ¾ inch×¾ inch contours into the right speaker cover flat end.
611A-E: five of 12V DC 16-18 gauge wire. Two of these wires have been extended 3 inches; A: The positive red wire from the charger and B: The joined power and accessory wires of the head unit 1.

FIG. 3 shows a top center, head unit's front panel view of the multimedia device 900.

1: Head unit's front panel (Dual XRM59BT)
2: Pipe (rear part)
26: Neck strap (Bonded leather)
27: Right side mobile device holding bay
38: Left side mobile device holding bay
50: Left side speaker cover
57: ½ inch self drilling screw.
58: Hole for screw.
55: ½ inch self drilling screw.
56: Hole for screw.

Important: In a preferred embodiment there are two of ½ inch self drilling screws for both two mobile device bays in the same location, only side by side. This is ideal to prevent the bays from rotating.

72A-E: Five holes in neck strap 26. These can be used as screw holes if neck strap is shortened.

FIG. 4 displays the center head unit entry area of the multimedia device 900.

1: Head unit (Dual XRM59BT)
2: 4 inch PVC pipe
15: Right side ¾ inch self drilling screw
27: Right side mobile device holding bay
36: SPST Rocker switch
37: Left side ¾ inch self drilling screw
39: Hole for screw
40: Hole for screw
200: Female antenna socket outlet
631: Hole for head unit FIG. 5A shows another front center full view, with the addition of a battery terminal plug view 6,46.

1: Head unit (Dual XRM59BT)
2: 4 inch PVC pipe
96: ½ self drilling screw

97: ⅞ inch Washer
888: Hot glue or epoxy (JB weld) in a preferred embodiment.

Figure 5B:
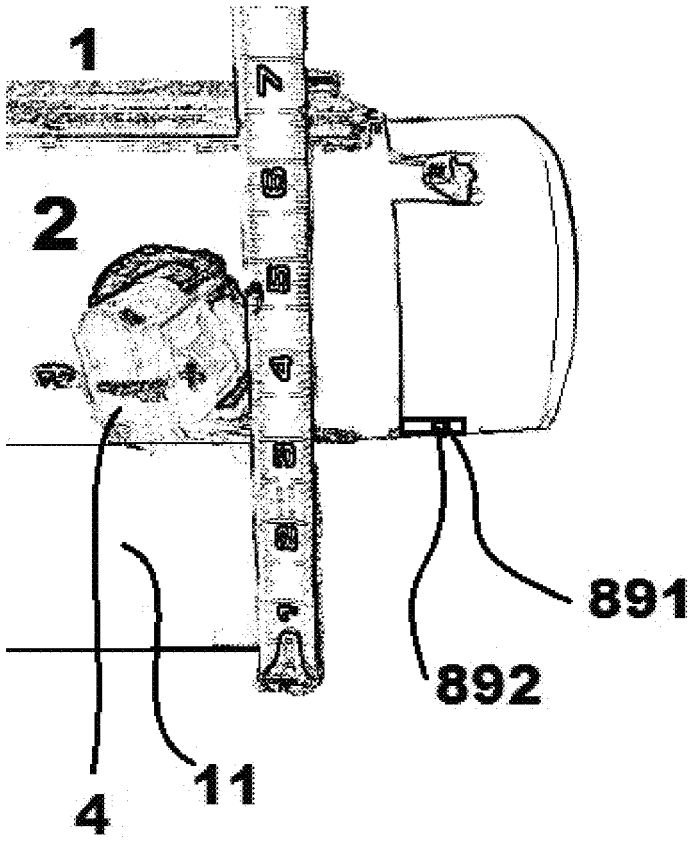
FIG. 5B, illustrates; a front right, partial view of the multimedia device.

FIG. 5B displays a front right partial view of the right half of the multimedia device 900.

1: Head unit (Dual XRM59BT)
2: 4 inch PVC pipe
4: 12V DC M12 XC battery pack for Milwaukee M48-11-2401
11: Box base
891: ½ inch self drilling screw
892: Hole for screw FIG. 6A shows a left side rear view of the multimedia device 900.

1: Head unit
2: Pipe
8: 120V AC power cable
11: Box base
26: Carry strap
27: Right side mobile device holding bay
38: Left side mobile device holding bay
50: Left side speaker cover
66A-I: Nine sticky felt pads. These are used to provide a smooth surface for the box base 11
77: ½ inch self drilling screw
78: Hole for screw
86: ½ inch self drilling screw
87: Hole for screw
88: ½ inch self drilling screw
89: Hole for screw
92: ½ inch self drilling screw
93: Hole for screw
115: 4¼ inch Oatey Universal Snap-Tite shower strainer (white plastic)
500: Left side 4 inch Pioneer TS-G1020S 4-in 2-Way Coaxial Car Speaker FIG. 6B illustrates a right side rear view of the multimedia device 900

8: 120V AC power cable
11: Box base
15: ¾ inch self drilling screw
19: Right side 4 inch Pioneer TS-G10205 4-in 2-Way Coaxial Car
26: Neck strap
40: Hole for screw
62: Right side speaker cover Canplas 4" DWM PVC Sewer Adapter Sleeve
71: Right side speaker screen 4¼ inch Oatey Universal Snap-Tite shower strainer (white plastic). These screens have a few mm trimmed off of their circumferences in order to fit into the Canplas 4" DWM PVC Sewer Adapter Sleeves 50,62 inner diameter.
300A-D: Striped engraved semi-transparent decorations at the center of every side (4 total) travelling straight vertically, from top to bottom of the box base 11.
301: Galaxy Tab A 10.1 inch mobile device tablet in the two bays of the multimedia device 900.

Figure 6B:
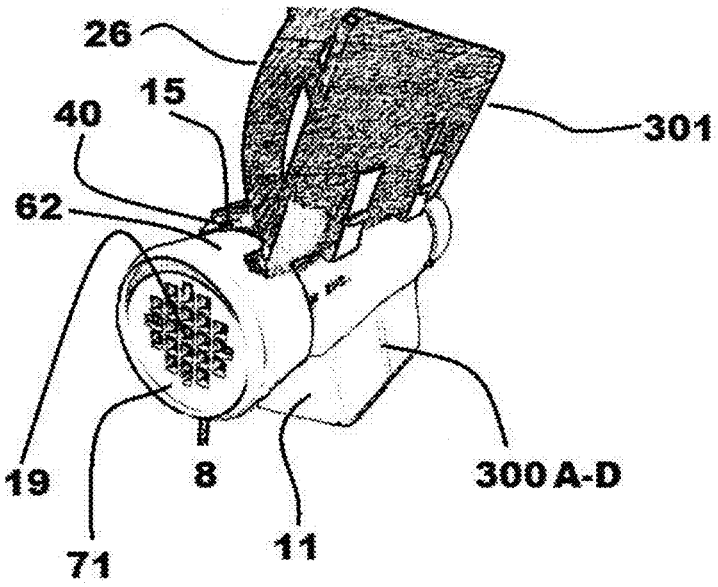
FIG. 6B, illustrates; a right side, rear full view of the multimedia device with a mobile tablet resting in the two mobile device holding bays.
Figure 6C:
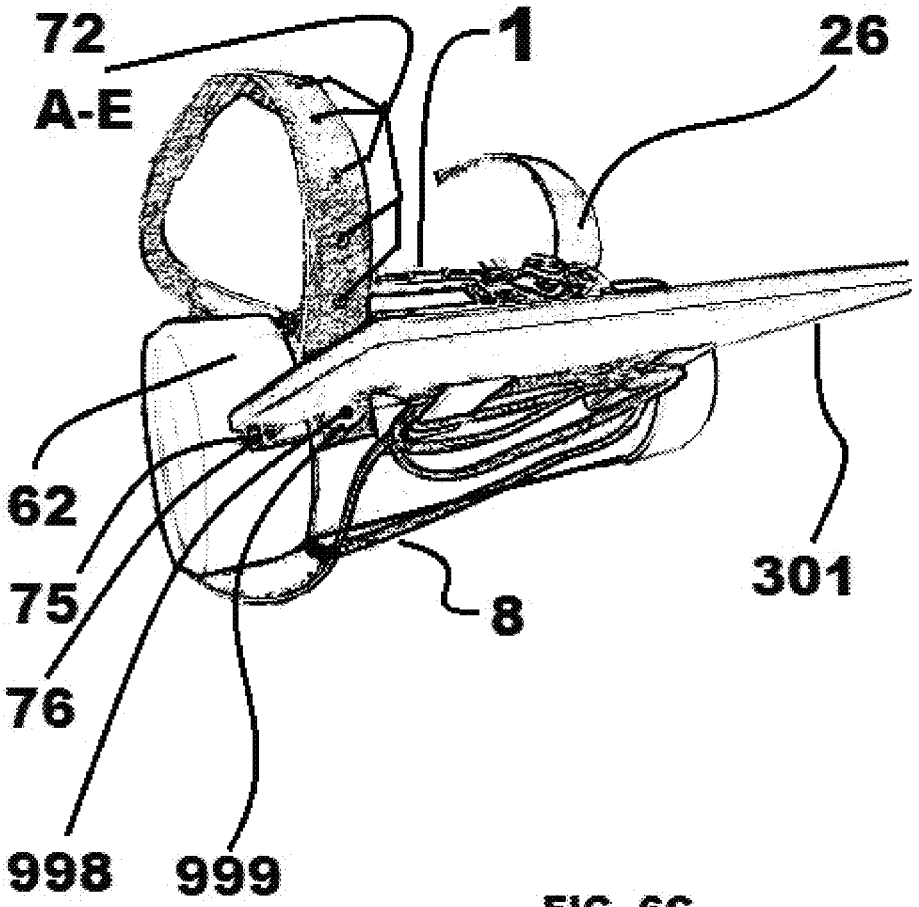
FIG. 6C, illustrates; a right side rear and top, angled full view of the multimedia device with a mobile tablet resting in the two mobile device holding bays.

FIG. 6B illustrates a right side rear, top view of the multimedia device 900.

Figure 7:
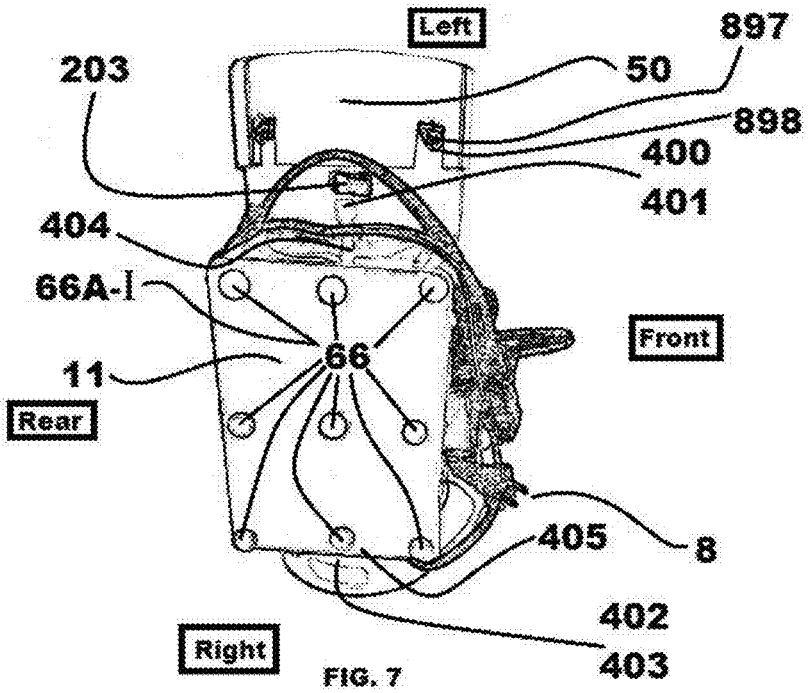
FIG. 7, illustrates; a bottom up, full view of the multimedia device.

1: Head unit (Dual XRM59BT)
8: 120V AC power cable
26: Carry strap
62: Right side speaker cover Canplas 4" DWM PVC Sewer Adapter Sleeve
72A-E: Five of 2 mm holes 1 inch apart on carry strap 26. These holes are original to the pants belt
75: ½ self drilling screw
76: Hole for screw
301: Galaxy Tab A 10.1 inch mobile device tablet
998: ½ inch self drilling screw
999: ⅞ inch washer FIG. 7 shows a bottom up, left side view of the multimedia device 900.

Figure 8A:
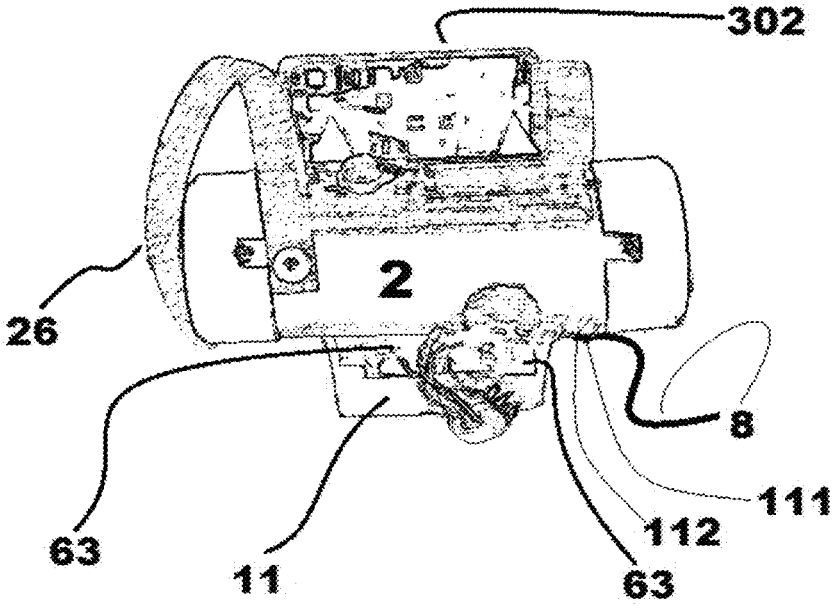
FIG. 8A, illustrates; a front view of the multimedia device with a mobile smart phone resting in its mobile device holding bays.

8: 12V AC Power cable
11: Box base
50: Left speaker cover
66A-I: Felt pads
203: Left side speaker vent hole measures 1 inch long by ½ inch wide. The hole is located bottom dead center of the PVC pipe 2 and starts 2 mm away from the end of the sleeve when fully pushed over the pipe 2 up to the screws 15,37.
400: Zip-tie ¼ inch wide
401: ¼ hole in pipe 2 for zip-tie
402: Zip-tie ¼ inch wide
403: ¼ hole in pipe 2 for zip-tie
404: ¼ hole in box base 11 for zip-tie
405: ¼ hole in box base 11 for zip-tie
897: ½ inch self drilling screw
898: Hole for screw FIG. 8A displays a mobile device smart-phone holding view on the multimedia device 900.

Figure 8B:
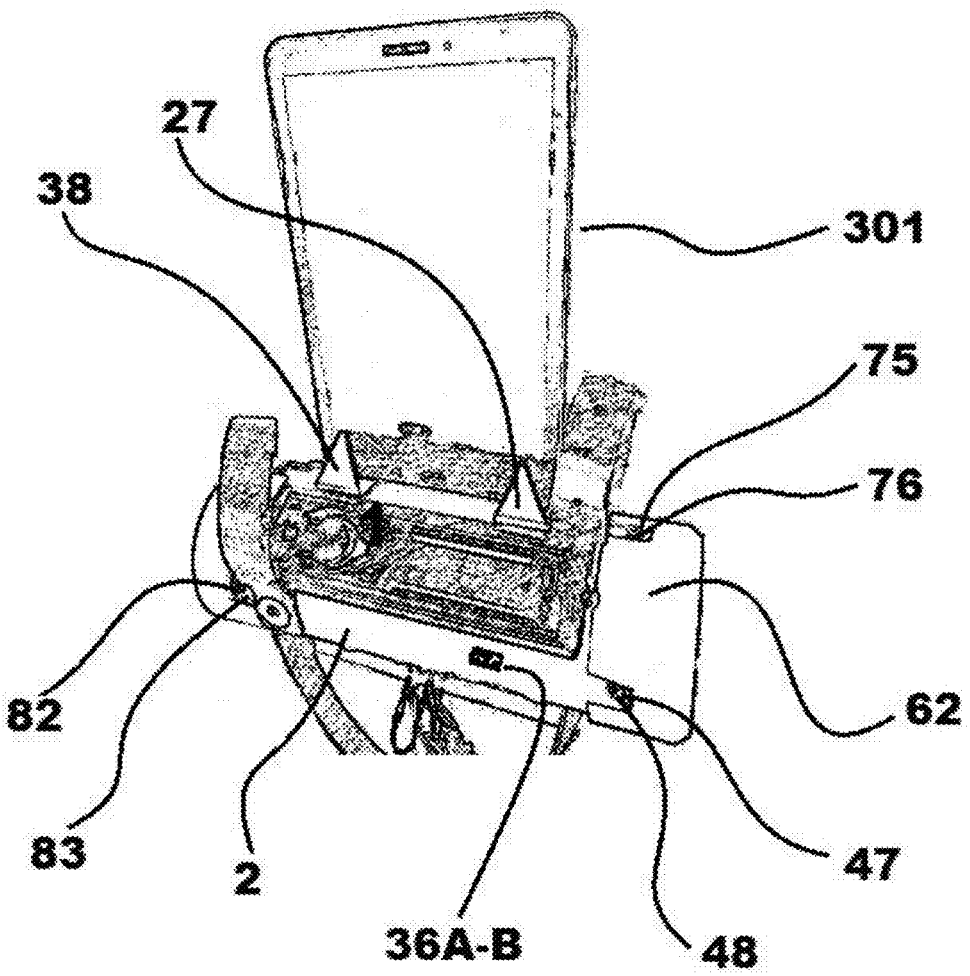
FIG. 8B, illustrates; a top, right side, full front view with a mobile tablet resting in its mobile device holding bays.

8: 120V AC power cable
2: Pipe
11: Box Base
26: Carry strap
63: Energup M12 XC and M18 charger circuit board
111: ¾ inch self drilling screw
112: ¾ inch washer
302: Mobile device smart-phone FIG. 8B shows a right side, top front, mobile device tablet view on the multimedia device 900.

Figure 8C:
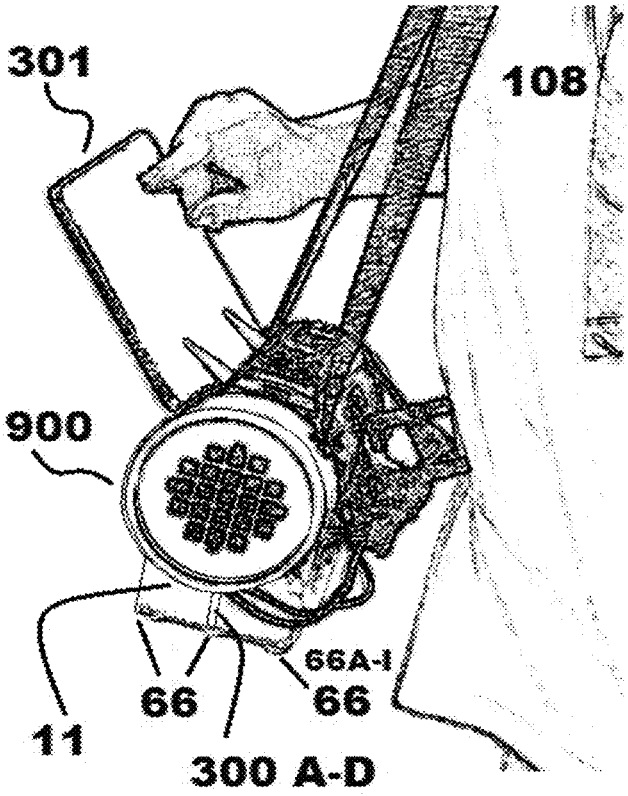
FIG. 8C, illustrates; a top, substantially left view of the multimedia device being carried along with a mobile tablet resting in its mobile device holding bays.

2: Pipe
27: Right side mobile device holding bay
36A-B: Switch
38: Left side mobile device holding bay
47: ½ self drilling screw
48: Hole for screw
62: Right side speaker cover
75: ½ self drilling screw
76: Hole for screw
82: ½ self drilling screw
83: Hole for screw
301: Galaxy Tab A 10.1 inch Tablet mobile device FIG. 8C illustrates a top view, substantially left, of the multimedia device 900, with the mobile device 301, Galaxy Tab A tablet resting on its mobile device holding bays 27,38.

11: Box base
66A-I: Felt pads
108: Person carrying multimedia device 900 and tablet mobile device 301 by the carry strap 26 over the person's neck.
301: Galaxy Tab A 10.1 inch mobile device FIG. 8D illustrates a further away (compared to FIG. 8C), left side, mobile device tablet view.

108: Person carrying multimedia device 900 via carry strap 26 over the neck. The multimedia device 900 is carrying the mobile device tablet 301 as well.

FIG. 9 Displays an Over the door Hook which both two are modified by cutting the shorter hook side into a triangle shape (area of cut is pointed to by the bottom arrow) using this entire short section and trimming off 1 mm from the top of the triangle so that the triangle is not pointy. This over the door hook is 27,38 throughout the drawings. Finally as the top arrow points to in FIG. 9, the top hook area is cut off measured 2⅝ inches from the most bottom edge of the sharp bend measured to the cutting point; where the roundish bend begins.

Figure 10:
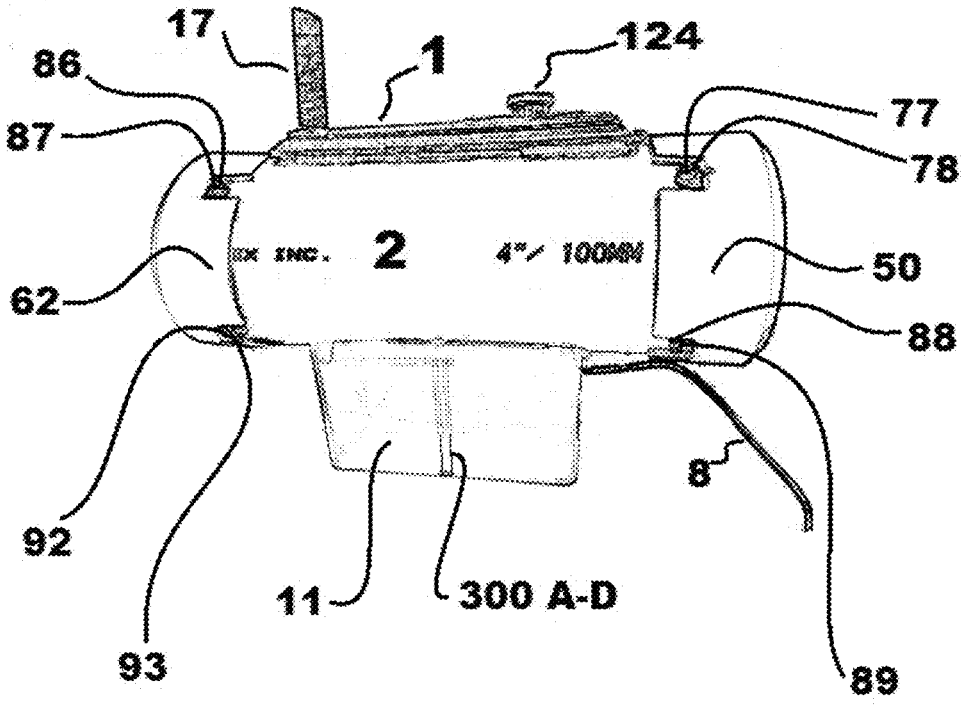
FIG. 10, illustrates; a rear center, full view of the multimedia device, slightly positioned to the left.

FIG. 10 shows a slightly left side rear view of the multimedia device 900.

Figure 11:
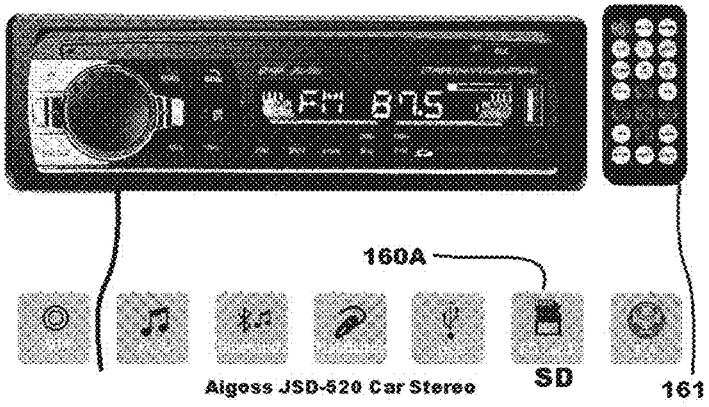
FIG. 11, depicts; a front panel perspective view alternative embodiment of a different car stereo 1 able to fit in the 4 inch pipe 2. This is the only feasible, alternative embodiment, discovered thus far.

1: Head unit (Dual XRM59BT)
2: Pipe
8: 120V AC power cable
11: Box base
17: EAGET USB flash drive
50: Right side speaker cover
62: Left side speaker cover
77: ½ inch self drilling screw
78: Hole for screw
86: ½ inch self drilling screw
87: Hole for screw
88: ½ inch self drilling screw
89: Hole for screw
92: ½ inch self drilling screw
93: Hole for screw
124: Volume of head unit's front panel
300 A-D: Box base decorations FIG. 11 illustrates an alternative embodiment of a car stereo receiver with the extra features of a wireless remote 161 and SD card slot. A limitation regards the removable faceplate; will no longer be able to be removed without removing the two self drilling screws 15,37 which fasten the head unit 1 to the pipe 2.

Figure 12:
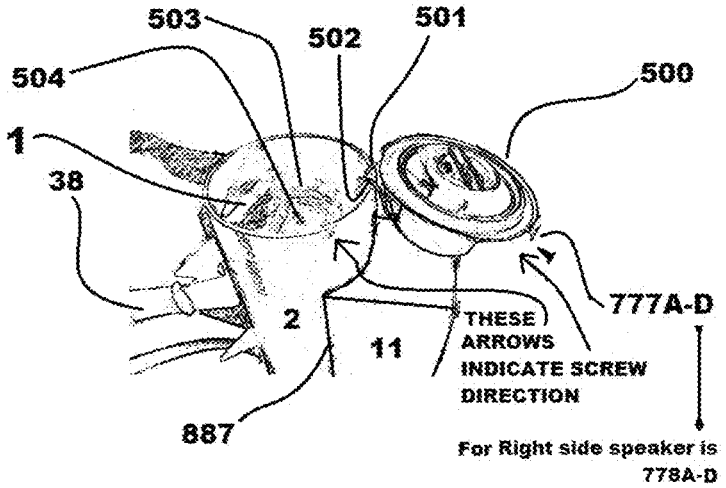
FIG. 12, illustrates; a left side, open pipe, internal view of the multimedia device.

FIG. 12 displays a left side open pipe view of the multimedia device 900.

1: Head unit (Dual XRM59BT)
2: Pipe
11: Box base
38: Left side mobile device holding bay
500: Left side speaker
501: Positive left speaker wire
502: Negative left speaker wire
503: ½ inch spruce wood, used as the internal cabinet separator is cut to diameter of pipe 2 for the exception of a carving for the rear of the head unit 1: Measured 1⅜ inch from the end of the pipe 2 to the surface of the spruce wood when in proper position within the pipe 2.
504: This center area of the spruce wood is ¼ inch deeper and 1 mm larger than the circumference of the center left speaker 500 magnet so that this magnet rests inside this trench and the speaker is able to line up with the screw holes: 83, 898 (front),
78,89 (rear)
777A-D: Are the four, 90 degrees inward bent speaker tabs, bent toward the speaker magnets, for the left side speaker to align with the holes 83, 898 (front), 78,89 (rear) of the pipe 2.
778A-D: Are the four, 90 degrees inward bent speaker tabs for the right side speaker to align with the holes 48, 892 (front), 87,93 (rear), of the pipe 2.
887: Hot glue surrounding box base 11 top perimeter. In an alternative embodiment silicone may be used and in a preferred embodiment this process is eliminated.

Figure 13:
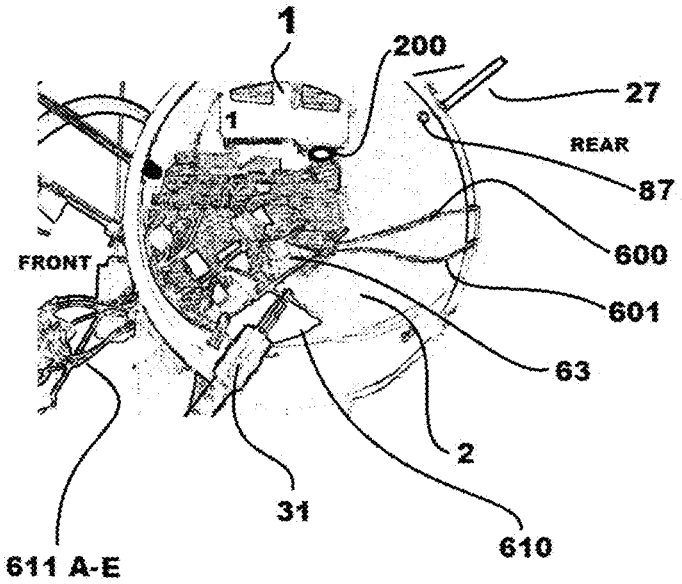
FIG. 13, illustrates; a substantially right, open pipe, internal view of the multimedia device.

FIG. 13 illustrates a substantially right internal view of the multimedia device 900.

1: Head unit (Dual XRM59BT)
2: Pipe
27: Right side mobile device holding bay
31: Four foot 3.5 mm auxiliary cable
63: Charger circuit board
87: Hole for screw
200: Antenna socket female outlet labeled ANT on head unit 1 rear end
600: Right speaker positive wire
601: Right speaker negative wire
610: 5 inch long×3 inch wide rectangular hole cut for the charger's circuit board 63 protrusion
611A-E: five of 12V DC 16-18 gauge wires, displaying its junction to the battery terminal plug 6 and at the other end it joins solder points on the charger 6.

Figure 14A:
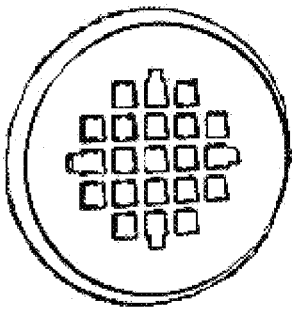
FIG. 14A, illustrates; an outer center view of a speaker cover and screen for the multimedia device.
Figure 14B:
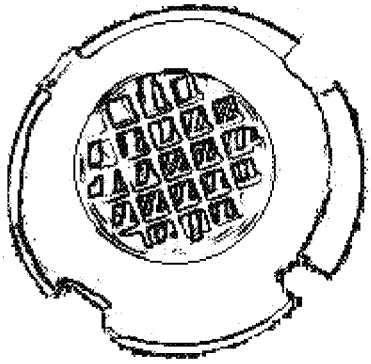
FIG. 14B, illustrates; an inner center view of a speaker cover and screen for the multimedia device.

FIG. 14A,B shows an inner and outer view of the speaker covers 50,62 as also shown; slid over the pipe 2 of the multimedia device 900, in many other drawings.

Figure 15:
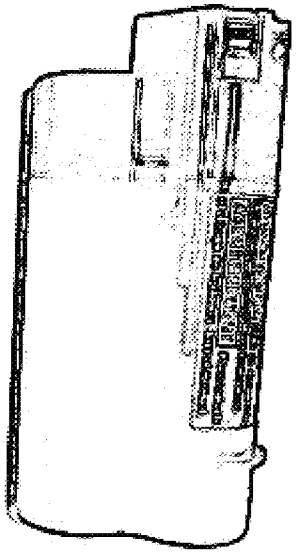
FIG. 15, illustrates; a battery pack view of its length

FIG. 15 illustrates a top length view of the battery pack 4.

FIG. 16A Displays a preferred embodiment top view of a box base 11 of the same dimensions only shorter in height: 2 inches tall and able to store up to three extra m12 XC batteries 4 inside, combined with the embodiment which has the 50% reduced charger circuit board entirely enclosed in the pipe 2.

Figure 16B:
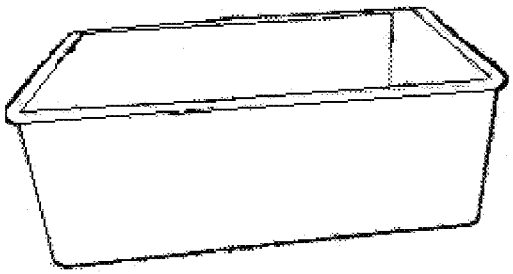
FIG. 16B, illustrates; displays; a shorter box base 11 preferred embodiment. Display of box base only.

FIG. 16B shows a side measurement of the preferred box base embodiment.

Figure 17:
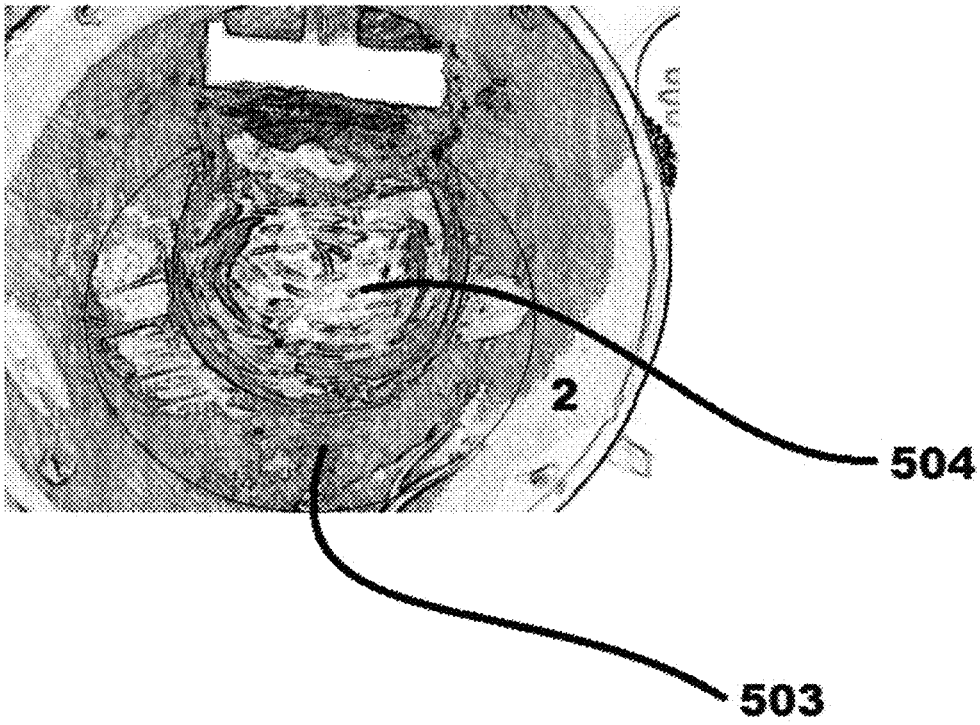
FIG. 17, illustrates; a substantially left internal view of the multimedia device highlighting the spruce wood fitted inside as the internal cabinet separator.

FIG. 17 shows a substantially left internal spruce wood view.

Hot glue surrounds its circumference perimeter which serves the purpose of an air seal so completely separate the 2 chambers. Epoxy or Jb weld may be used in a preferred embodiment.

503: Outer spruce surface, ½ inch diameter spruce wood.
504: Inner carving ¼ inch deep FIG. 18 illustrates a substantially left close-up L.E.D view

7: Green L.E.D displays full charge status and faults
11: Box base
63: Charger
65: Red L.E.D displays a charge in progress status and faults
115: Left speaker screen. These screens have a few mm trimmed off of their circumferences in order to fit into the Canplas 4" DWM PVC Sewer Adapter Sleeves 50,62 inner diameter.
400: Zip-tie ¼ inch wide
401: ¼ hole in pipe 2 for zip-tie
404: ¼ hole in box base 11 for zip-tie
633D,E,F: Hot glue points. Epoxy or JB weld in a preferred embodiment.

Figure 19:
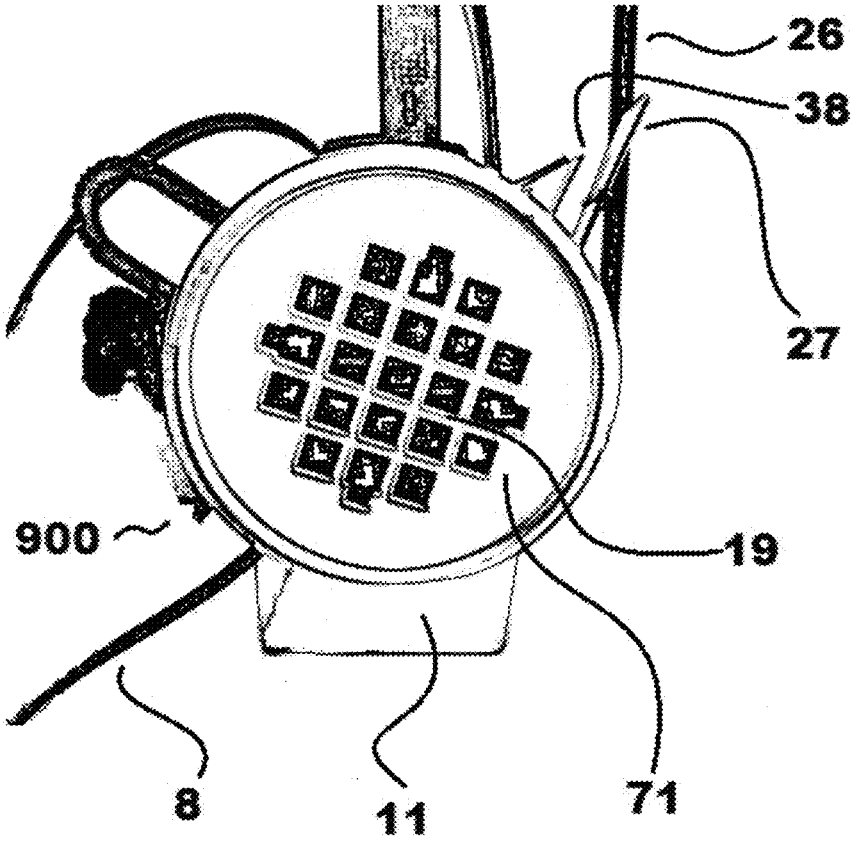
FIG. 19, illustrates; a substantially right side view of the multimedia device.

FIG. 19 displays a substantially right side view of the multimedia device 900.

8: 120V AC power cable
11: Box Base
19: Right side speaker
26: Carry strap
27: Right side mobile device holding bay
38: Left side mobile device holding bay
71: Right side speaker screen FIG. 20 illustrates a wiring and connection diagram.

Figure 21:
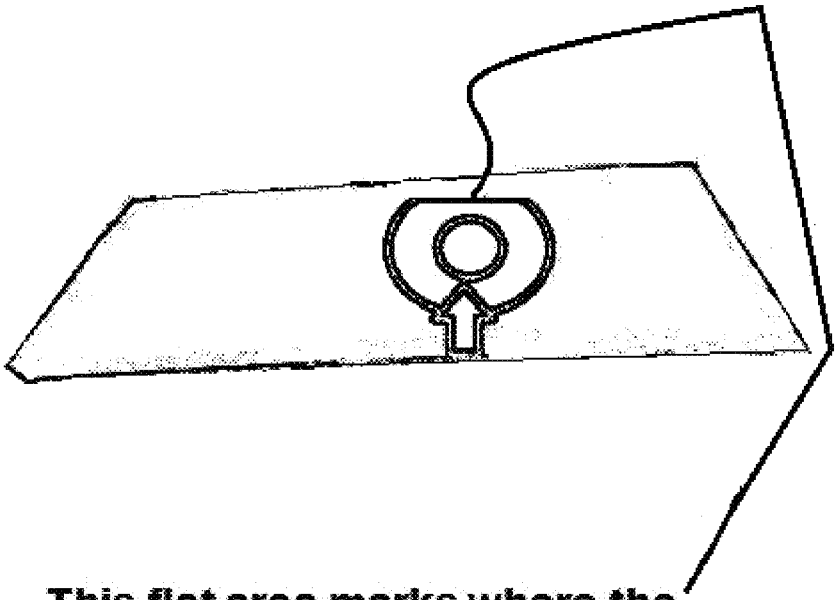
FIG. 21, illustrates; a top length view of the spruce wood.

The positively charged metal pad of the battery terminal plug 6 has a wire soldered that then travels to the switch 36 input and is soldered at this point. The power and accessory wires of the car stereo is soldered to the output terminal of the switch 36. This diagram also displays features of the head unit 1 includes; two audio input connections. In further detail, one of the audio inputs is a USB drive female slot. It is also able to send 5V DC electricity to charge mobile devices. The other audio input is a 3.5 mm auxiliary female slot. Further, there are RCA audio outputs but they are not easily accessible since the right speaker 19 must be initially removed from the pipe 2: The diagram also illustrates the communication module of the head unit which provides Bluetooth connectivity with a mobile device. There are also two hot buttons featured on the head unit's 1 front panel; A: Answer a call B: Microphone FIG. 21 displays spruce wood circumference and shape marking as well as the inner circumference marking to be carved ¼ inch deeper.

503: Spruce wood

504: ¼ inch center carving of ½ inch spruce wood

Figure 22A:
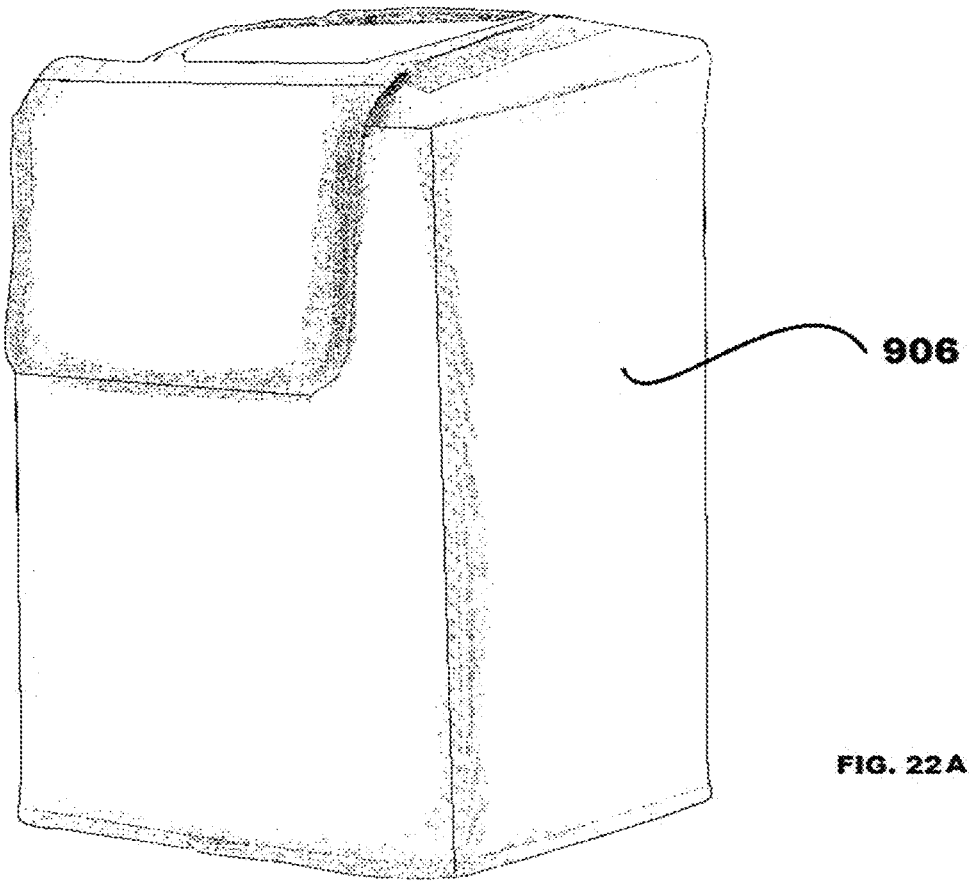
FIG. 22A, illustrates; an upper view of a preferred embodiment, multimedia device cover.
Figure 22B:
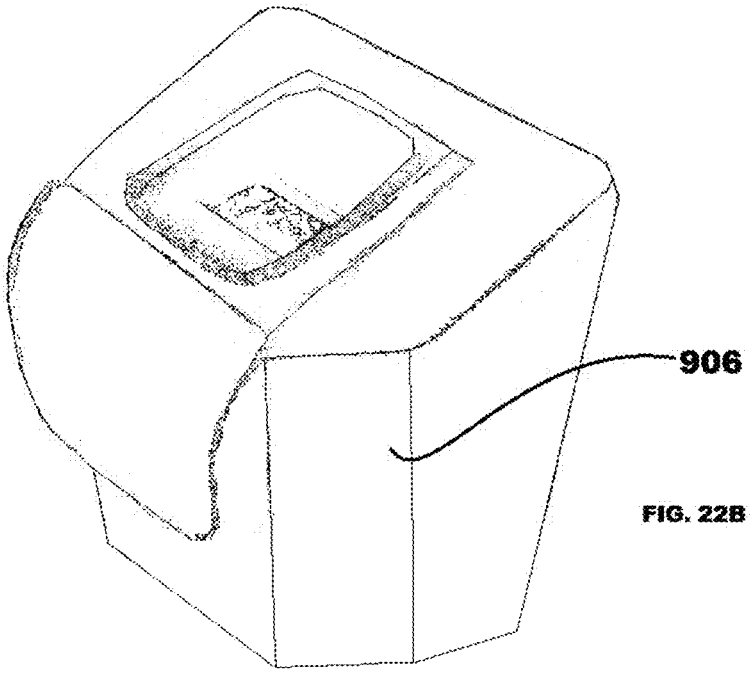
FIG. 22B, illustrates; an upper view of a preferred embodiment, multimedia device cover.

FIG. 22A,B shows a 8 inch Gator speaker cover 906 for some weatherproof and waterproof features in a preferred embodiment of the multimedia device 900. Fits speakers up to 18 inch×11 inch×11 inch. Dimensions: 44.7×29×29 cm.

Figure 23A:
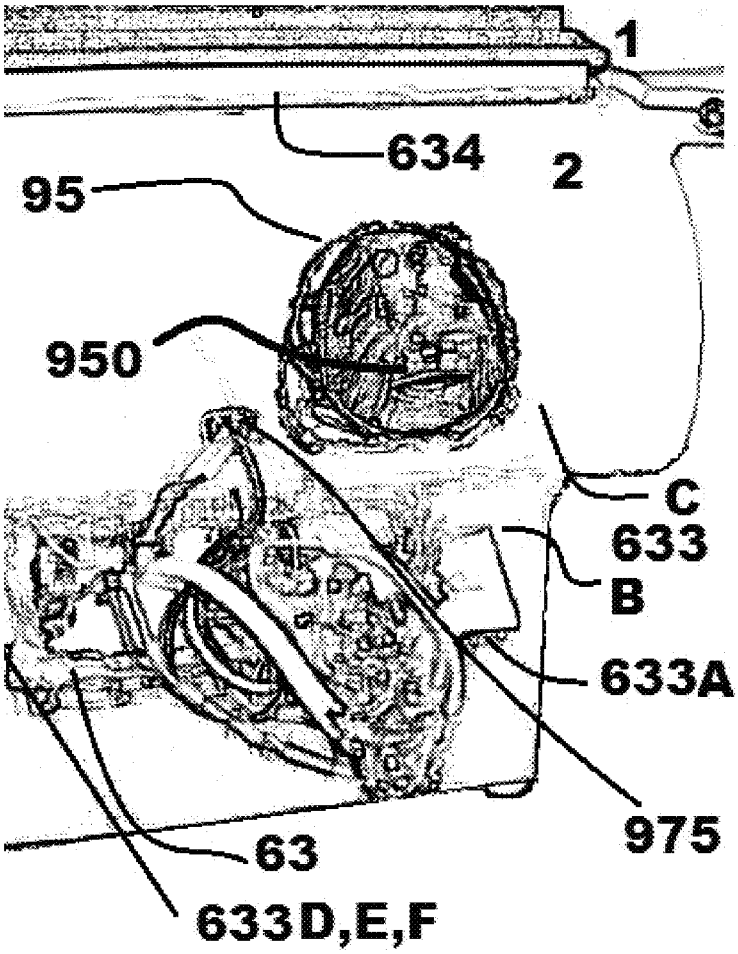
FIG. 23A, illustrates; a front right partial view highlighting the internal battery bay 950.

FIG. 23A illustrates the internal battery bay 950 area of the multimedia device 900.

1: Head unit

2: Pipe

95: Battery pack hole:

Position of battery bay hole 95: 7½ inch from left side end to center of battery bay hole 95, by 4⅛ inch from bottom of felt pads 66 below the box base 11 to center of battery bay hole 95. Battery bay hole 95 is 1⅞×1⅞ inch following shape of the m12 XC battery pack by PowerExtra. In a preferred embodiment, the internal battery bay is epoxy glued (JB weld) to the speaker magnet instead of hot glue for improved longevity of the adhesive.

633A-D: There are six total hot glue points for the circuit board, A is the bottom right, B is where the board meets the rectangle cutout 610 of the pipe 2 and C is at the top of the circuit board as it is positioned in the multimedia device 900. D,E,F in FIG. 18; is the same concept, only the opposite side of the circuit board 63. In an alternative embodiment, Epoxy (JB weld) may be used. Further in a preferred embodiment, a reduced charger board 63 in size would equate to only four instead of six adhesive points necessary.

634: Hot glue between the head unit below boarder of front panel and pipe 2 next to hole 631

950: Internal Battery Bay measures: 1¾ inch wide×1¾ inch long×1¾ inch deep

975: ⅜ inch square hole

Figure 23B:
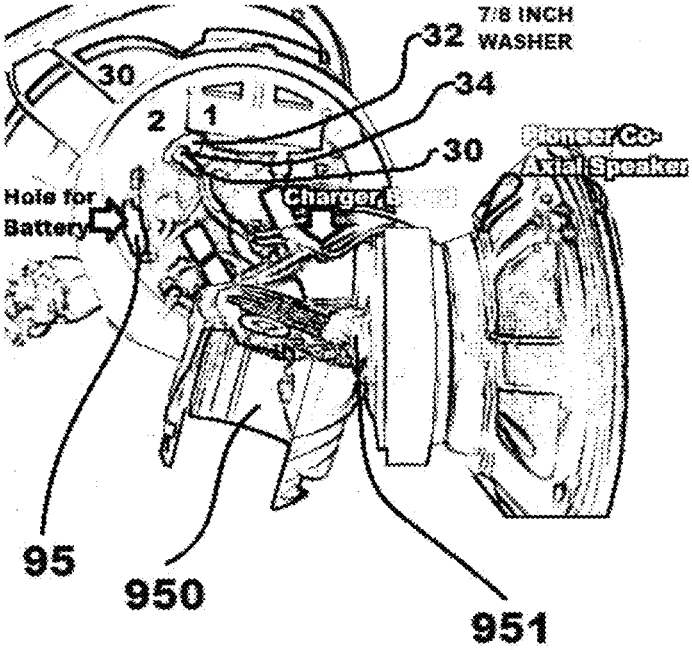
FIG. 23B, illustrates; a substantially right, internal view highlighting the battery bay's hole 95 and internal battery bay 950 attached to the right side speaker 19.

FIG. 23B displays a substantially right view inside the pipe 2 along with a view of the right side 19 speaker and internal battery bay 950 attached.

Internal Antenna Parts:

32: ⅞ inch washer

34: ¼ inch nut

30: U-bolt 4 inch long×¼ inch diameter

31: 3.5 mm auxiliary cable

FIG. 24 shows a 52 mm rubber heat shrink 46 diameter view

Figure 25:
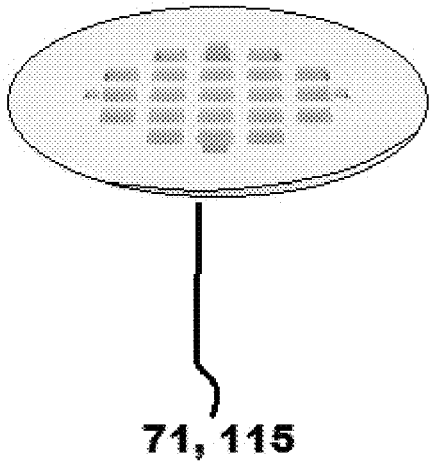
FIG. 25, illustrates; a top view of a speaker screen.

FIG. 25 illustrates a separate speaker screen 71, 115 top view. A few millimeters must be trimmed off of their circumferences in order to fit them into the speaker cover sleeves 50,62. The speaker covers comprises two Canplas 4 inch DWM PVC Sewer Adapter Sleeves.

What is claimed is:

1. A boombox comprising:

a pipe that encloses:

a single din car stereo receiver;

a switch;

a speaker cabinet separator;

a rechargeable drill battery;

a charger circuit board;

LED indicators; and co-axial car speakers;

wherein, the pipe comprises:

holding bays for two mobile devices, constructed with rubber loop, wherein the rubber loop is able to configure in different shapes and sizes;

wherein, the pipe further comprises:

a carry handle u-bolt which can be configured in variety of shapes and sizes; and an auxiliary cable antenna with a male adapter that is able to secure into the car stereo receiver's antenna socket and wrapped securely around said u-bolt.

* * * * *